US007845121B2

(12) United States Patent
Wobben

(10) Patent No.: US 7,845,121 B2
(45) Date of Patent: Dec. 7, 2010

(54) FACILITY USED FOR THE PRODUCTION AND/OR ASSEMBLY OF GOODS

(76) Inventor: Aloys Wobben, Argestrasse 19, Aurich (DE) 26607

( * ) Notice: Subject to any disclaimer, the term of this patent is extended or adjusted under 35 U.S.C. 154(b) by 495 days.

(21) Appl. No.: 11/632,023

(22) PCT Filed: Jul. 6, 2005

(86) PCT No.: PCT/EP2005/053219

§ 371 (c)(1),
(2), (4) Date: Mar. 4, 2008

(87) PCT Pub. No.: WO2006/003207

PCT Pub. Date: Jan. 12, 2006

(65) Prior Publication Data

US 2008/0264459 A1 Oct. 30, 2008

(30) Foreign Application Priority Data

Jul. 7, 2004 (DE) ..... 10 2004 032 945

(51) Int. Cl.
*E04H 14/00* (2006.01)

(52) U.S. Cl. ..... 52/173.1; 52/79.5; 52/745.01; 52/63; 52/222; 52/96; 212/225

(58) Field of Classification Search ..... 52/79.5, 52/745.01, 63, 173.1, 222, 96, 135; 212/204, 212/255, 260, 262, 223, 225, 226, 201; 135/87, 135/99
See application file for complete search history.

(56) References Cited

U.S. PATENT DOCUMENTS 71,682 A * 12/1867 Batten ..... 212/225
981,456 A * 1/1911 Mitchell ..... 104/92
1,313,108 A * 8/1919 Nord ..... 212/223
1,417,013 A * 5/1922 Andrews ..... 212/204
1,543,134 A * 6/1925 Todd ..... 52/13
1,625,118 A * 4/1927 Grant ..... 254/131
3,018,546 A * 1/1962 Dewese ..... 29/431
3,106,299 A * 10/1963 Pingon ..... 212/176
3,449,884 A * 6/1969 Joor ..... 52/745.01
3,496,687 A * 2/1970 Greenberg et al. ..... 52/109
3,546,831 A * 12/1970 Kratky et al. ..... 52/115

(Continued)

FOREIGN PATENT DOCUMENTS

CN 2123572 U 12/1992

(Continued)

*Primary Examiner*—Robert J Canfield
*Assistant Examiner*—Matthew J Gitlin
(74) *Attorney, Agent, or Firm*—Seed IP Law Group PLLC

(57) ABSTRACT

There is proposed a preferably transportable (mobile) and/or re-usable production facility, as is quick and easy to erect virtually at any location in this world. This production facility virtually comprises a tent structure, wherein the roof of the facility is held by at least one carrier (support) and at the same time at least one device for raising or lowering or moving goods or parts thereof, for example crane structures, is also provided on the carrier itself. Such a crane structure can be of a variable configuration and facilitate in particular the production of goods which are heavy and/or which for assembly can no longer be raised or moved by human strength.

7 Claims, 4 Drawing Sheets

U.S. PATENT DOCUMENTS

| | | | | | |
|---|---|---|---|---|---|
| 3,625,235 | A | * | 12/1971 | Gorgichuk | 135/87 |
| 3,889,698 | A | * | 6/1975 | Roessl | 135/94 |
| 3,906,685 | A | * | 9/1975 | Howard | 52/63 |
| 3,948,056 | A | * | 4/1976 | Sumner | 405/207 |
| 3,949,962 | A | * | 4/1976 | Wilson | 249/18 |
| 4,033,367 | A | * | 7/1977 | Johnston | 135/100 |
| 4,106,244 | A | * | 8/1978 | Kessler et al. | 52/63 |
| 4,367,761 | A | * | 1/1983 | Winant | 135/87 |
| 4,371,303 | A | * | 2/1983 | Fritzsche et al. | 414/281 |
| 4,502,527 | A | * | 3/1985 | Brewer | 164/418 |
| 4,820,101 | A | * | 4/1989 | Fenn | 414/21 |
| 4,826,023 | A | * | 5/1989 | Ortemond | 212/176 |
| 4,942,895 | A | * | 7/1990 | Lynch | 135/99 |
| 5,036,874 | A | * | 8/1991 | Lynch | 135/99 |
| 5,061,148 | A | * | 10/1991 | Petz | 414/564 |
| 5,163,360 | A | * | 11/1992 | Petz | 99/468 |
| 5,259,077 | A | * | 11/1993 | Hager et al. | 4/498 |
| 5,444,943 | A | * | 8/1995 | Schelfhorst | 52/63 |
| 5,762,006 | A | * | 6/1998 | Ubaldi et al. | 110/235 |
| 6,000,175 | A | * | 12/1999 | Gale et al. | 52/63 |
| 6,000,192 | A | * | 12/1999 | Cohen et al. | 52/745.2 |
| 6,253,504 | B1 | * | 7/2001 | Cohen et al. | 52/143 |
| 2002/0083654 | A1 | * | 7/2002 | Bini | 52/66 |

FOREIGN PATENT DOCUMENTS

| | | | | |
|---|---|---|---|---|
| DE | 2312509 | | | 10/1974 |
| DE | 137131 | | | 8/1979 |
| DE | 68909169 | T | | 4/1994 |
| DE | 4427164 | A1 | | 2/1996 |
| DE | 29800471 | U1 | | 6/1999 |
| DE | 10208850 | A | | 9/2003 |
| DE | 10230273 | B3 | | 2/2004 |
| EP | 0411126 | A1 | | 2/1991 |
| JP | 59175550 | U | | 11/1984 |
| JP | 02100995 | A | * | 4/1990 |
| JP | 04306366 | | | 10/1992 |
| JP | 6018379 | U | | 3/1994 |
| JP | 0701457 | | | 1/1995 |
| JP | 07117035 | A | | 5/1995 |
| JP | 2001271516 | A | | 10/2001 |
| JP | 2003118688 | A | | 4/2003 |
| WO | WO 9104382 | A1 | * | 4/1991 |

* cited by examiner

FACILITY USED FOR THE PRODUCTION AND/OR ASSEMBLY OF GOODS

BACKGROUND OF THE INVENTION

1. Field of the Invention

The invention concerns a facility for the production and/or assembly of goods. As is known, such facilities are factories or fixed buildings in which there are machines and also transport capacities for producing individual parts of an article and/or putting together a complete article from a number of individual parts, that is to say assembling the article, and then further processing or transporting the article produced in that way.

2. Description of the Related Art

However, for the production and assembly of goods, it is not always worthwhile to just erect an entire factory building. The reasons for this are not only general costs, but can also be that a given project has to be performed at a given location, but subsequently production at that location no longer makes any further economic sense.

EP 0 411 126 A1 discloses an industrial building having various cells, wherein a crane is arranged at the centre of each cell and serves to hold a horizontal platform of a ceiling construction.

JP 04306366 A discloses a roof construction for a crane in order to be able to carry out building works even in bad weather.

DE 44 27 164 A1 discloses a tent which is held by a crane. In that arrangement the crane is disposed with its jib outside the tent so that the crane can access components within the tent only at a location with a corresponding opening in the roof of the tent.

DD 137 131 discloses a large-chamber double silo. A rotary cane is provided within each silo.

DE 102 08 850 A1 discloses an assembly works for the assembly of industrial products. In particular shown therein is an assembly works for motor vehicles. The assembly works substantially comprises a main module with laterally disposed secondary modules.

DE 298 90 471 also discloses an installation for the production of industrial goods.

DE 689 09 169 T2 discloses a method and a modular building arrangement for industrial buildings. A building can be erected by means of a multiplicity of those modules.

BRIEF SUMMARY OF THE INVENTION

According to one embodiment, the present invention provides a simple solution so that the production of goods at a given location is also possible without having to erect expensive factory buildings, for example, by providing a facility as set forth in one or more of the attached claims. Advantageous developments are set forth in the appendant claims.

In accordance with the invention there is proposed a preferably transportable (mobile) and/or re-usable production facility, such as to be quickly and easily erected at virtually any location in this world. The production facility comprises virtually a tent structure, wherein the roof of that facility is held by at least one carrier as the support and also at the same time at least one device for raising or lowering or moving goods or parts thereof, for example crane structures, is provided on the carrier itself. Such a crane structure can be of a widely variable configuration and facilitates in particular the production of goods which are very heavy and which for assembly cannot be lifted or moved by human strength.

The invention includes the idea of using a commercially available rotary crane, in particular a commercially available rotary tower crane, as a main support for a production tent.

According to one alternative, a lightweight construction hall is equipped with a transport or crane capacity and to which modular units, for example in the form of containers, can be docked, so that the hall itself forms the working space while the respective kind of production is defined by way of the connected modular production units. The essential production know-how is therefore made available by the docked modular unit, in which respect that know-how also includes in particular machines and in particular also those items of equipment which are required for the assembly and/or handling and/or production of the goods to be produced.

It will be appreciated that it is also possible to place not just one modular unit but a plurality thereof in the production facility in order thus to allow the most possible complex production of a plurality of different goods.

BRIEF DESCRIPTION OF THE SEVERAL VIEWS OF THE DRAWINGS

The invention is described in greater detail hereinafter by means of an embodiment. In the drawing.

DETAILED DESCRIPTION OF THE INVENTION

Figure 1:
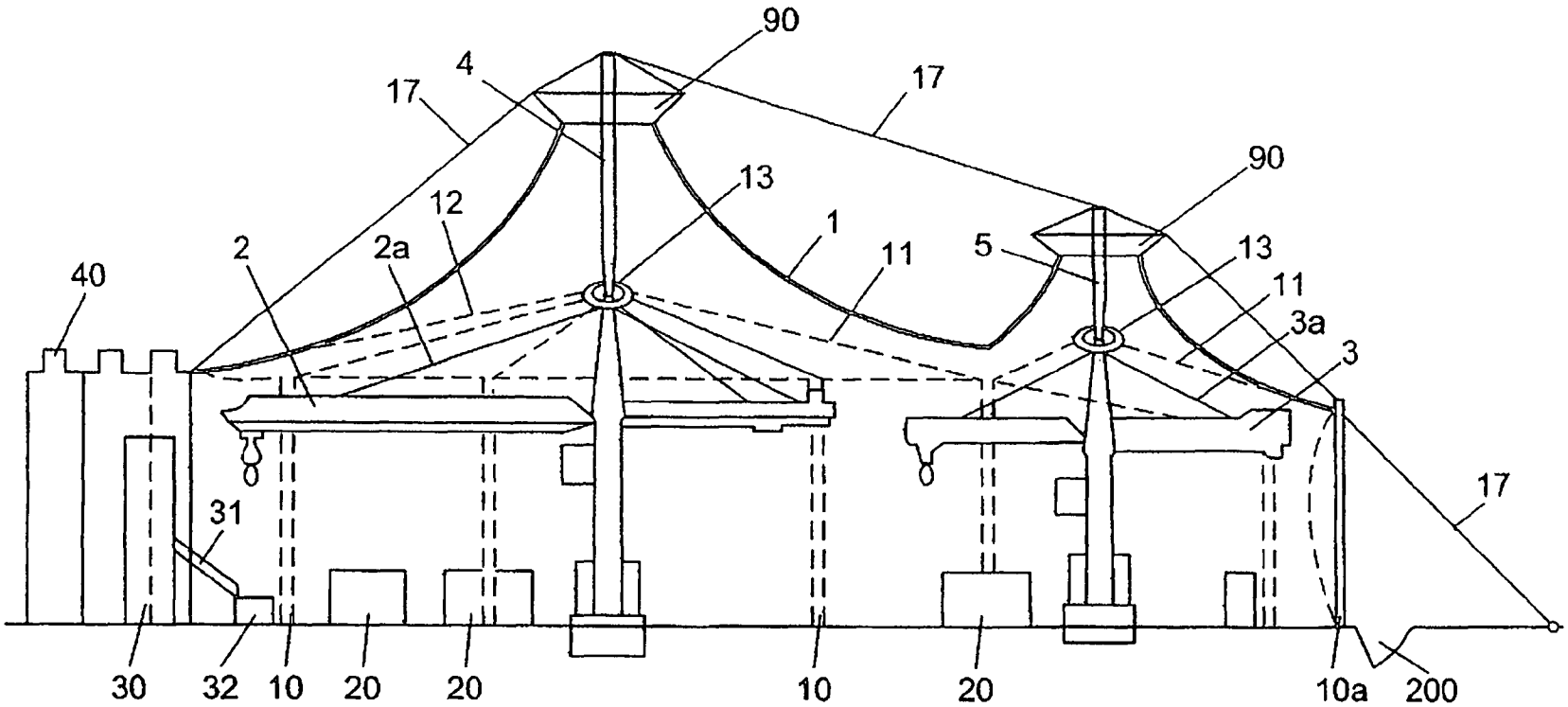
FIG. 1 shows a perspective view in section of a mobile production facility in accordance with a first embodiment by way of example.

FIG. 1 shows a perspective view in section of a production hall or a production tent 1 according to one embodiment. In this case the production tent 1 preferably comprises two tent units which are connected together. The two tent units are supported by a large crane 2 and a small crane 3. Both cranes 2, 3 can be commercial rotary tower cranes (as shown). In order to increase the height of the tent 1 above the crane height, a support element 4 is mounted on the large crane 2 and a support element 5 is mounted on the small crane 3. Accordingly the two cranes 2, 3 carry the vertical loads of the tent 1. Cables 12, 17, in particular steel cables, are used for lateral support for the tent 1. In that case, two tips of the two tent units, respectively, are connected together by a tensioning cable 17, while further tensioning cables 17 are connected to an outer post 10*a*. In order further to improve stability, pillars 10 are disposed at least one edge of the tent 1, the pillars 10 being connected by means of tensioning cables 12 to a ring 13 through which the support 4 extends. The ring 13 serves for connecting the pillars 10 to each other, not however for transmitting the forces from the support.

A concrete mixing installation 30 with corresponding silos 40 is provided toward at least one edge of the tent 1. The concrete can be conveyed into containers 32 by way of a chute 31 so that those containers 32 with the concrete can be transported by means of the large crane to appropriate locations in the tent 1. Provided at predetermined positions in the tent 1 are individual production departments 20 which serve to carry out the various production steps. The concrete can then be poured into a mold or used as a component for a product. After the concrete has cured, the crane 2 can pick up the completed product and place it on a truck or some other transportation vehicle to remove the assembled part from the structure.

A respective ventilation opening 90 can be provided at the tip of each of the large and small cranes 2, 3. In addition a trench 200 for water drainage can be provided laterally at the tent 1.

While FIG. 1 shows a tent 1 comprising two sub-tents, the mobile production unit can also be implemented only with one tent. As an alternative thereto the (mobile) production unit may also be implemented with a plurality of tents.

Figure 2:
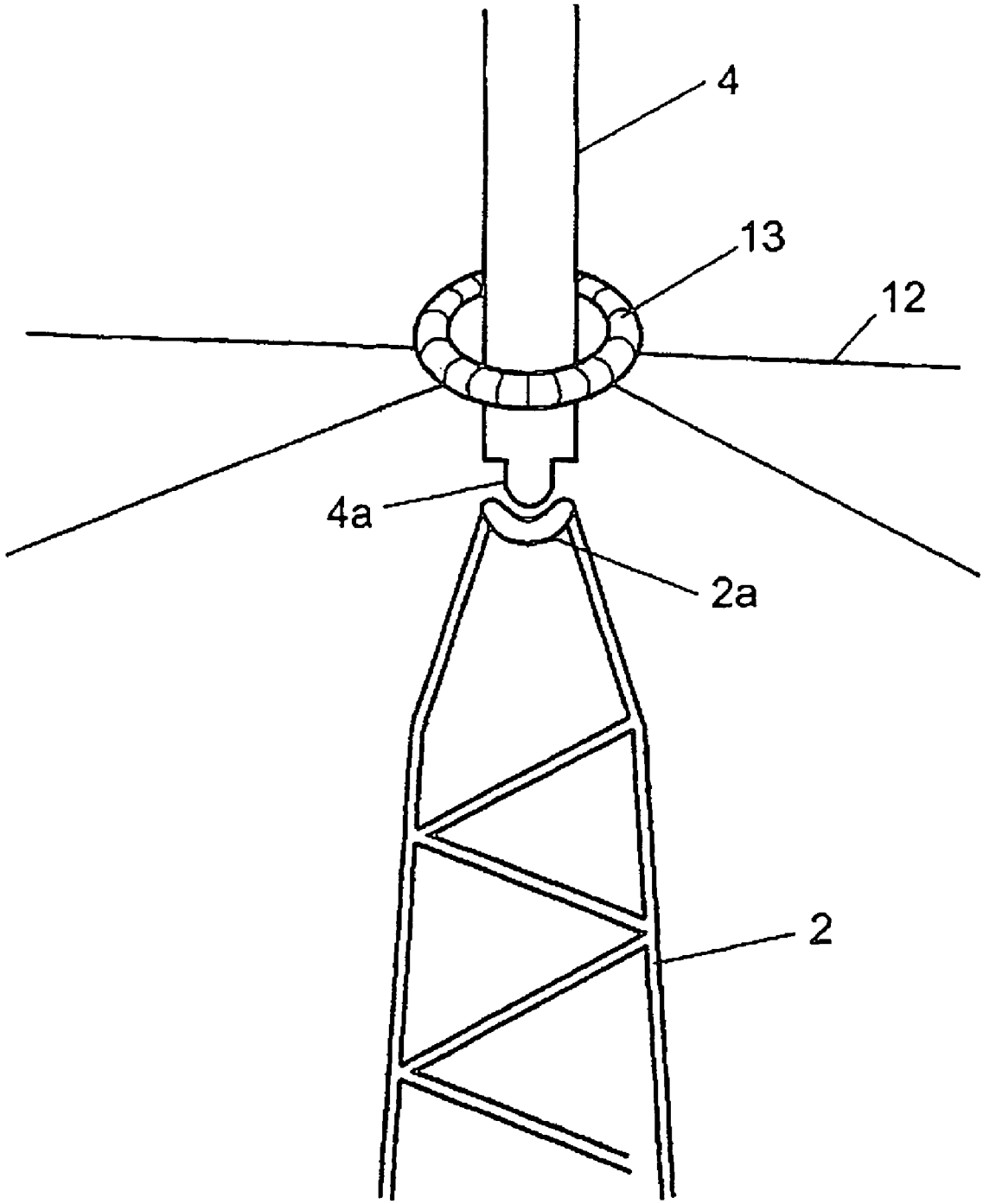
FIG. 2 shows a portion of the arrangement of FIG. 1.

FIG. 2 shows a portion of the perspective sectional view of FIG. 1. Here the transition between the crane 2 and the support 4 is shown in greater detail. In this case the crane 2 has a pivot joint socket 2*a* at its tip. At its one end which is towards the crane 2 the support 4 has a pivot joint ball 4*a* which is fitted into the pivot joint socket 2*a*. By virtue of that arrangement of the pivot joint socket 2*a* and the pivot joint ball 4*a*, the crane can rotate without the support 4 also rotating therewith. This pivot joint socket connection is shown as a general schematic of one acceptable coupling. Many other acceptable couplings can be used which connect the support 4 to the crane 2, including a closed socket connection, a ball and joint or other connection. A pivot joint ball and a pivot joint socket can also be provided between the small crane 3 and the support 5.

A ring 13 is also shown. Shown on the ring 13 are the cables 12, preferably made of steel, extending between the ring 13 and the respective pillars 10. In this case the cables 12 serve for lateral stabilization of the tent. The arrangement of the ring 13 provides that the forces can be transmitted between the posts or away from the posts without in that case influencing the support 4.

Figure 3:
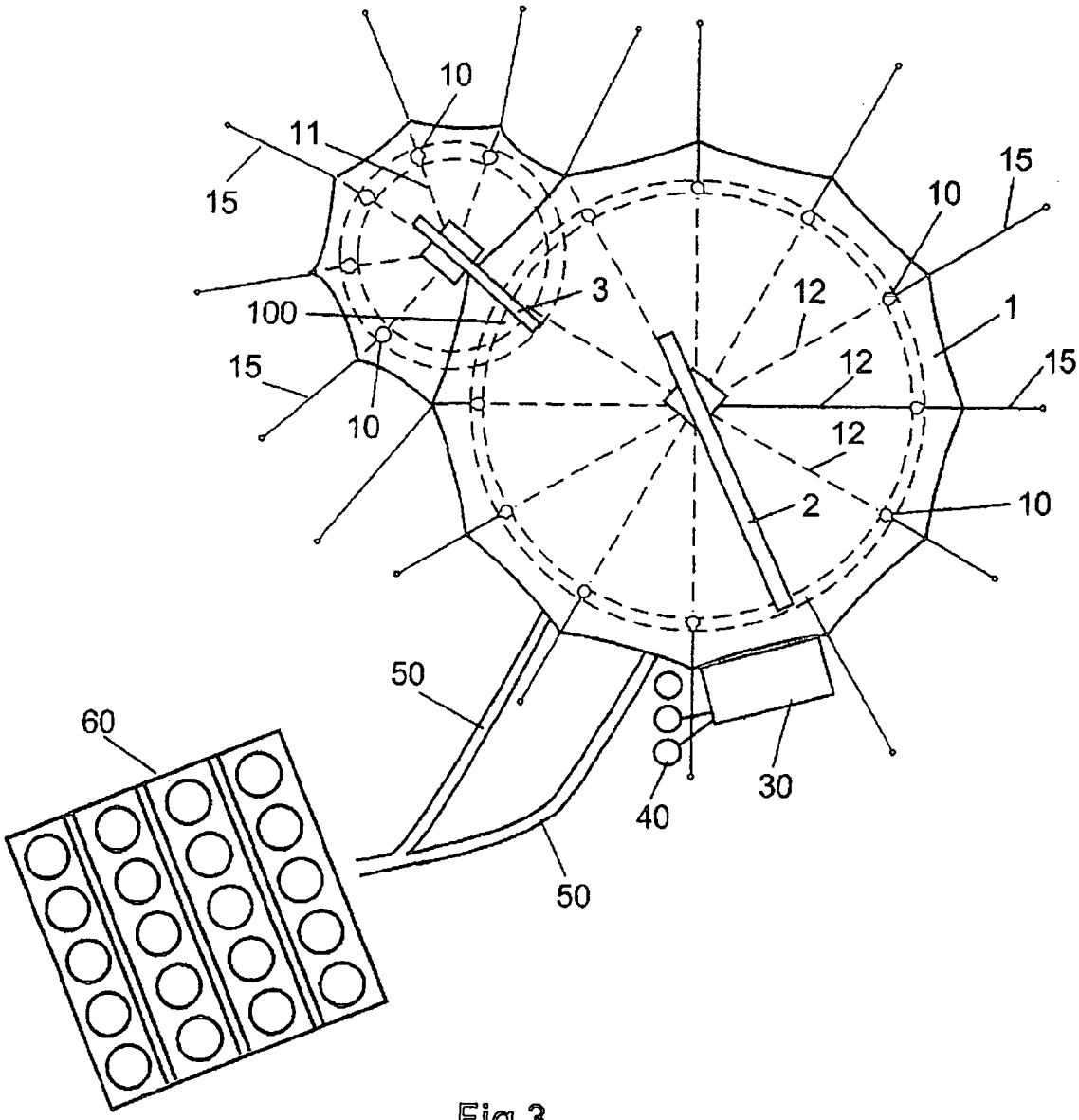
FIG. 3 shows a plan view of the mobile production hall of FIG. 1.

FIG. 3 shows a plan view of the production unit of FIG. 1. In this case also the production unit is formed from two tents which are connected together. The two cranes 2, 3 in this arrangement serve to carry the vertical forces. Arranged at the tent 1 are a plurality of pillars 10 which are connected by means of cables 12 to the ring 13 (not shown) to carry away the forces. The large crane 2 and the small crane 3 are arranged in this case in such a way that their respective radii of action overlap in the portion 100. Accordingly, a production operation can be effected in the radius of action of the small crane 3, that is to say in the small tent, in which case the goods produced can then be transported by means of the small crane 3 into the portion 100 where the goods can then be further assembled and/or transported into the large tent by the large crane 2. Once again a concrete mixing installation 30 with the corresponding silos 40 is shown externally at the large tent. Paths 50 which extend within the tents are provided for transporting or transporting away the goods produced. In this respect those paths 50 are better consolidated than the remaining region of the tent floor which for example can comprise gravel.

A storage area 60 for the goods produced can also be provided outside the tent.

By way of example, pylon segment portions of wind power installations can be produced from concrete and reinforcements, in the production facility. For that purpose, the reinforcement is suitably laced together to produce a cage, in the small tent. The small crane 3 then moves the laced cage into the portion 100 so that the large crane 2 can take over the cage and can set it down at the suitably provided place 20 (FIG. 1) in the large tent. The corresponding concrete casting shuttering is placed around the cage and the concrete produced by the concrete mixing installation 30 is transported to the concrete shuttering for example by means of the containers or buckets 32 and poured into the shuttering. After the concrete has set, the shuttering is removed and a corresponding transport apparatus transports the finished concrete parts to the storage area 60. That is preferably effected over the consolidated paths 50.

As an alternative to the above-described transport of the concrete by means of buckets 32 (FIG. 1), the large crane 2 can also be provided with a suitable concrete pump so that the concrete can be pumped from the concrete mixing installation 30 into the corresponding shuttering moulds at the respective working area 20 (FIG. 1).

The above-described production unit can be used in particular for the production of prefabricated concrete elements, such as for example pylon segments for wind power installations or elements for prefabricated house production. In other words: it is possible to achieve series production of elements which are bulky and difficult to transport or which becomes bulky after assembly and wherein the raw materials are to be present on site or are to be easily transported thereto.

In regard to the production of concrete elements, it is important that when setting, the concrete elements are at a predetermined temperature. As a certain time is required until the concrete elements then cool down again, the heat which is produced in that situation can be employed to heat certain regions such as for example a living region (for the workers) in the immediate proximity of the mobile production unit.

Wind turbines are often constructed at remote locations, far from extra-wide or heavy-duty roads and at the tops of mountains or on islands, and also far from buildings, structures or other commercial production facilities. It might be that the cost to build the extra-wide or heavy-duty stable roads necessary to transport completed concrete pylons segments by trucks to the remote location will be impossible or cost prohibitive. According to this invention, the mobile production facilities can be set up at or near the final site for the wind turbine pylon. The raw materials, such as gravel, cement, water and other components can be brought on standard trucks which do not need an extra width or road supports. The wind turbine pylon segments of any size can then be manufactured in the mobile production hall 1. The mobile hall 1 can be built at a very low cost. When the construction of the wind tower components is completed, the mobile production hall 1 can be disassembled and moved to a new location to build a new wind turbine at a low cost. The impact on the environment is thus much less since heavy or bulky loads do not need to be transported over long distances and the cost is lower for the overall production of the final wind turbine.

The above-described re-buildable production facility can permit substantially autonomous production at many more or less inaccessible locations. In regard to power supply, it is advantageous to provide an autonomous current island network which is supplied with electrical power by means of diesel generators, wind power, solar power, by a flywheel or the like. Particularly at remote locations the power supply for a production facility can entail a not inconsiderable degree of complication and expenditure if for example the diesel for diesel generators has to be transported over great distances. In that respect, an improvement in the autonomous power supply is represented by the use of solar modules on the roof of the tent or solar modules which are integrated into the roof of the tent. For example the illumination for the production facility can be powered or partially powered by means of the solar modules and suitable energy storage devices. The provision of solar modules on the tent roof also has the advantage that the solar modules provide shade. Alternatively or additionally thereto, a wind power installation can be used for the power supply for the production facility. It will be appreciated that in that respect a wind power installation is particularly advantageous, which can be quickly set up and possibly removed again.

To provide hot water, tubes can be run on the tent roof or at the edge of the tent roof, which are filled with water so that that water is heated throughout the day by way of the solar radiation and thereafter can be used as process water for industrial use. This also has the advantage that the tent structure is further weighted down so that stability is increased.

In addition conveyor devices for bulk materials such as for example sand, cement or the like can be arranged in such a way that they lead from the exterior into the tent or the concrete mixing installation in order accordingly to transport the corresponding bulk materials to the required locations.

The floor covering of the tent can comprise gravel, as an alternative thereto the floor can also be surfaced.

Residential containers or residential tents for the workers of the installation can be set up in the proximity of the facility. A water processing installation for a supply of drinking water is preferably also provided. As workers are occupied for a certain period of time at the building site or during production, a mobile medical station including the necessary implements, equipment and the like can also be provided.

At certain portions within the tent, in particular at the inside wall of the tent, it is possible to provide a peripherally extending framework such as for example building scaffolding for the storage of small parts.

The production facility can be provided for rail construction, for the assembly of electricity pylons, for components of prestressed concrete bridges, for components for road construction, for prefabricated houses, for goods packaging, for foodstuffs storage and/or for the processing and loading for example of an oil mill, an oil storage facility, an oil freighting facility, for production/assembly of all parts of a wind power installation or a solar installation.

In accordance with a further embodiment of the invention there is provided a central support on which a ring with spokes can be pulled up. At least one traveling trolley can be provided on that ring with the spokes so that the traveling trolley can be used for raising goods or articles within the tent. Preferably the traveling trolley can also move along the spokes. A plurality of trolleys are also possible. Accordingly there is no need for the ring or the crane units 2, 3 to rotate as the traveling trolley can move along the outer ring and along the spokes.

Figure 4:
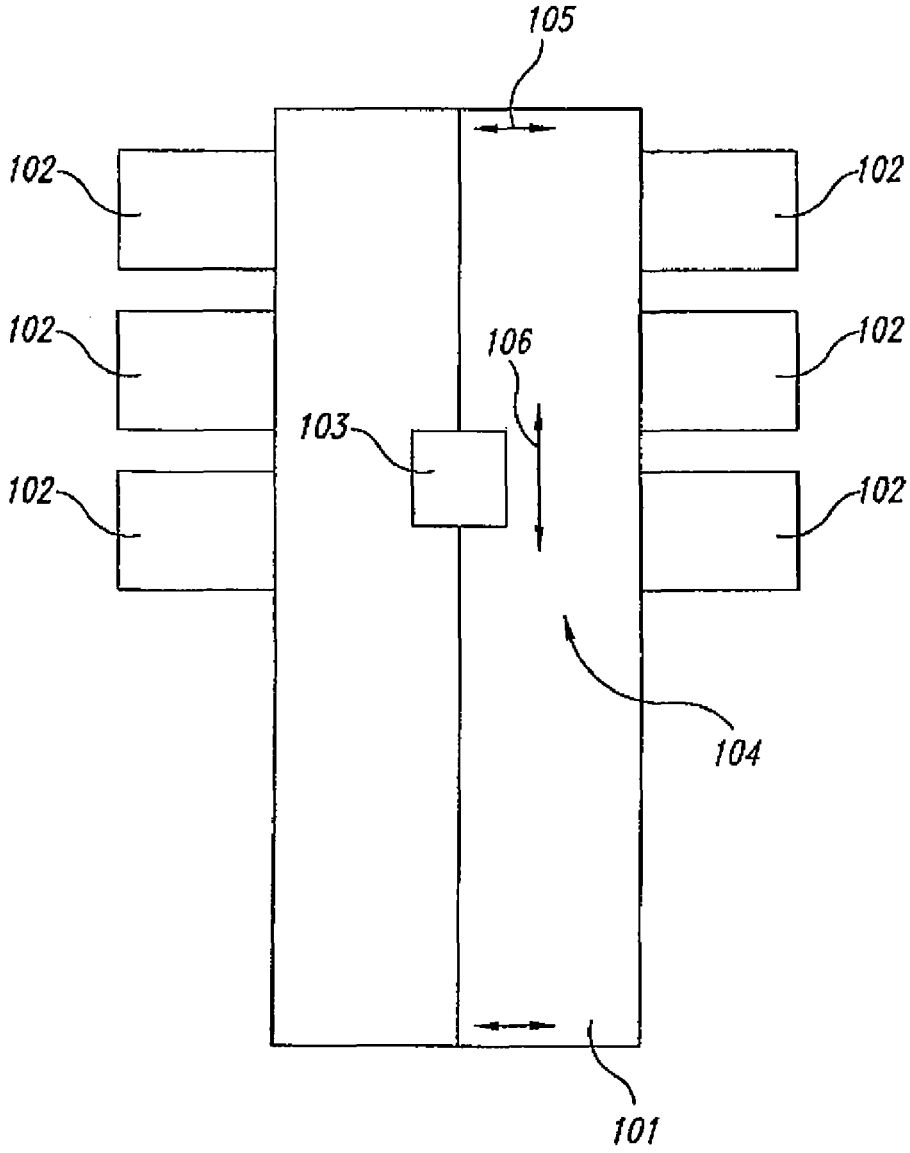
FIG. 4 shows a plan view of a production facility in accordance with a second embodiment.

FIG. 4 shows a plan view of a production facility in accordance with a further embodiment of the invention. Here a central unit 101 is firstly set up. That unit 101 can be implemented for example by a tent. Commercially available containers 102 can be docked to the outside of a hall 104 of the unit 101. For example standard workstations can be embodied in the containers 102 so that those workstations can be easily transported to and from between the various production facilities. A crane 103 which can move within the hall 104 is provided for transport of goods along at least two axes 105, 106 within the hall 104.

To erect the above-described unit 101 or hall 104 therefore it is only necessary to level the ground so that thereafter a support framework for the hall 104 can be set up, which for example is covered with a tent roof. The appropriately required special workstations are embodied as described hereinbefore in the containers 102 so that they only have to be docked to the hall 104.

That arrangement has in particular the advantage that halls of that kind can be easily transported and erected in a short time so that corresponding production can be effected at any locations.

The containers 102 just described above can also be docked to the production facilities described with reference to FIGS. 1 to 3 in order to provide specialist workstations such as for example laboratories or the like.

The above-described production facility can also be used to produce steel pylons for example for a wind power installation.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A production facility for at least one of production and assembly of transportable goods, wherein the production facility comprises:

a carrier including at least one crane structure having a tip and a pivot joint socket positioned toward the tip, the carrier configured to at least one of raise, lower, and move objects, the entire carrier being rotatable about an axis; and a tent structure having a roof and a pivot ball joint, the tent structure substantially supported by the carrier, the roof of the tent structure being arranged at least partially above the crane structure, the pivot ball joint of the tent structure configured to be rotatably coupled to the pivot socket joint of the crane structure, facilitating rotation of the crane structure about the axis without rotation of the tent structure.

2. A facility according to claim 1 wherein the carrier is adjustable in height.

3. A facility according to claim 1 characterized in that the crane structure comprises a circular or part-circular ring which is carried by a central support and that a lifting device on the crane structure is displaceable radially on the carrier or around the carrier.

4. A facility according to claim 3 characterized in that the crane structure is vertically displaceable and held by cables.

5. A production facility for at least one of production and assembly of transportable goods, wherein the facility comprises:

a carrier including at least one support member and at least one crane structure configured to at least one of raise, lower, and move objects;

a tent structure having a tip coupled to the support member, the tent structure being substantially supported by the carrier, the crane structure being entirely rotatably coupled to the support member and positioned beneath the support member, facilitating rotation of the crane structure without rotation of the support member.

6. The production facility according to claim 5 wherein the carrier is adjustable in height.

7. The production facility according to claim 5 wherein the support member includes a pivot ball joint and the crane structure includes a pivot socket joint, the pivot ball joint of the support member configured to be rotatably coupled to the pivot socket joint of the crane structure, facilitating rotation of the crane structure without rotation of the support member.

* * * * *